US008206268B2

(12) United States Patent
Haataja

(10) Patent No.: US 8,206,268 B2
(45) Date of Patent: Jun. 26, 2012

(54) DISPLAY MODE SELECTION

(75) Inventor: Jarkko Haataja, Tuusula (FI)

(73) Assignee: Polar Electro Oy, Kempele (FI)

( * ) Notice: Subject to any disclaimer, the term of this patent is extended or adjusted under 35 U.S.C. 154(b) by 0 days.

(21) Appl. No.: 13/004,270

(22) Filed: Jan. 11, 2011

(65) Prior Publication Data

US 2011/0105920 A1 May 5, 2011

Related U.S. Application Data

(63) Continuation of application No. 12/582,141, filed on Oct. 20, 2009, now abandoned.

(30) Foreign Application Priority Data

Oct. 21, 2008 (FI) ..... 20085993

(51) Int. Cl.
*A63B 71/00* (2006.01)

(52) U.S. Cl. ..... 482/8

(58) Field of Classification Search ..... 482/1, 7, 482/8

See application file for complete search history.

(56) References Cited

U.S. PATENT DOCUMENTS

| | | | | |
|---|---|---|---|---|
| 4,625,733 | A | 12/1986 | Saynajakangas | |
| 5,644,511 | A | 7/1997 | McWhorter | |
| 6,450,922 | B1 | 9/2002 | Henderson et al. | |
| 6,837,827 | B1 | 1/2005 | Lee et al. | |
| 6,921,351 | B1 * | 7/2005 | Hickman et al. | 482/8 |
| 2003/0208335 | A1 * | 11/2003 | Unuma et al. | 702/141 |
| 2006/0004265 | A1 | 1/2006 | Pulkkinen et al. | |
| 2007/0173377 | A1 | 7/2007 | Jamsen et al. | |
| 2007/0249468 | A1 | 10/2007 | Chen | |
| 2009/0209393 | A1 * | 8/2009 | Crater et al. | 482/9 |
| 2009/0322540 | A1 * | 12/2009 | Richardson et al. | 340/573.7 |

FOREIGN PATENT DOCUMENTS

| | | | |
|---|---|---|---|
| GB | 2437319 | A | 10/2007 |
| JP | 7096058 | A | 4/1995 |

* cited by examiner

*Primary Examiner* — Loan Thanh
*Assistant Examiner* — Shila Jalalzadeh Abyane
(74) *Attorney, Agent, or Firm* — Hoffmann & Baron, LLP

(57) ABSTRACT

An apparatus, a method, and a computer program are disclosed. The apparatus comprises a processor. The processor is configured to obtain exercise data of a user from a measurement sensor, to identify a present exercise phase of an exercise from among a plurality of exercise phases on the basis of the exercise data, and to select a relevant display mode from among a plurality of display modes on the basis of the present exercise phase and a mapping between the display modes and the exercise phases, wherein the relevant display mode defines a set of display elements associated with the present exercise phase to be displayed to the user.

19 Claims, 6 Drawing Sheets

DISPLAY MODE SELECTION

CROSS-REFERENCE TO RELATED APPLICATIONS

This application is a continuation of pending U.S. patent application Ser. No. 12/582,141, filed Oct. 20, 2009, which claims priority based on Finnish Patent Application No. 20085993, filed Oct. 21, 2008, both of which are incorporated herein by reference.

FIELD

The invention relates to display mode selection.

DESCRIPTION OF THE RELATED ART

The usability of personal measurement apparatuses, such as a running/cycling computer, needs further improvements. Especially the usability during an exercise is a big issue.

SUMMARY

The present invention seeks to provide an improved apparatus, an improved method, and an improved computer program.

According to an aspect of the present invention, there is provided an apparatus as specified in claim 1.

According to another aspect of the present invention, there is provided a method as specified in claim 8.

According to another aspect of the present invention, there is provided a computer program as specified in claim 14.

According to another aspect of the present invention, there is provided another apparatus as specified in claim 15.

According to another aspect of the present invention, there is provided another computer program as specified in claim 16.

BRIEF DESCRIPTION OF THE DRAWINGS

Embodiments of the present invention are described below, by way of example only, with reference to the accompanying drawings, in which.

DETAILED DESCRIPTION

The following embodiments are exemplary. Although the specification may refer to "an" embodiment in several locations, this does not necessarily mean that each such reference is to the same embodiment(s), or that the feature only applies to a single embodiment. Single features of different embodiments may also be combined to provide other embodiments.

FIGS. 1 to 4 only show some elements whose implementation may differ from what is shown. The connections shown in FIGS. 1 to 4 are logical connections; the actual physical connections may be different. Interfaces between the various elements may be implemented with suitable interface technologies, such as a message interface, a method interface, a sub-routine call interface, a block interface, or any means enabling communication between functional sub-units. It should be appreciated that apparatuses may comprise other parts. However, they are irrelevant to the actual invention and, therefore, they need not be discussed in more detail here. It is also to be noted that although some elements are depicted as separate ones, some of them may be integrated into a single physical element. The specifications of apparatuses 100 develop rapidly. Such development may require extra changes to an embodiment. Therefore, all words and expressions should be interpreted broadly, and they are intended to illustrate, not to restrict, the embodiments.

Figure 1:
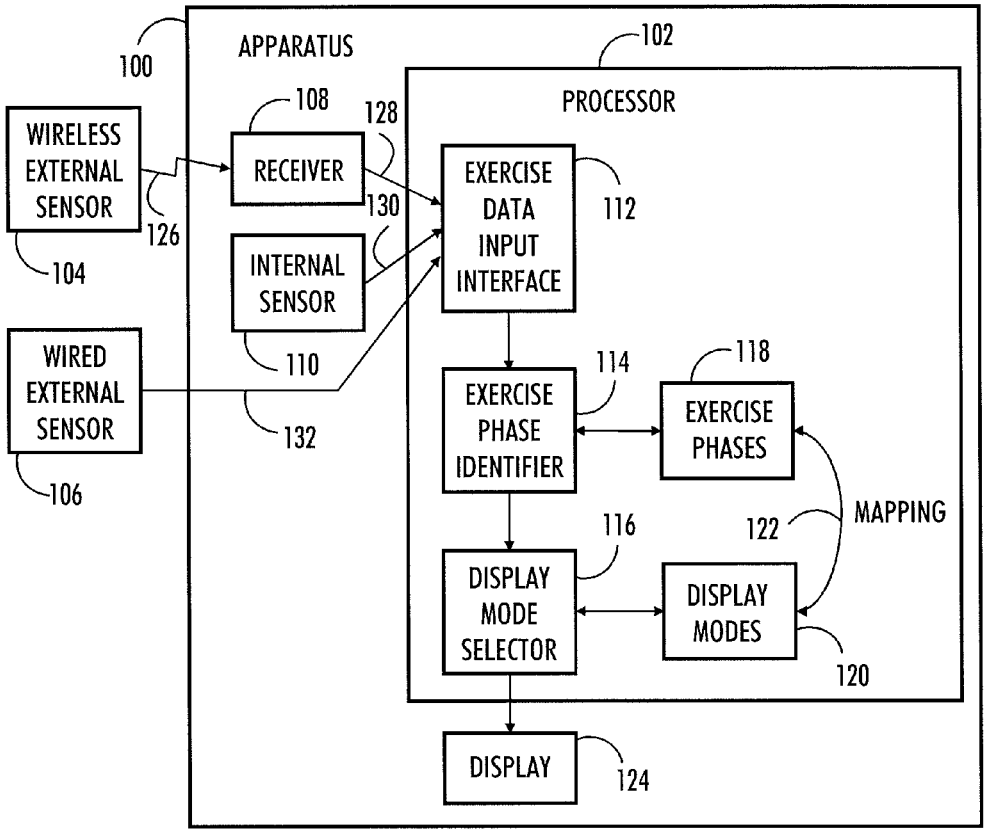
FIG. 1 illustrates an apparatus.

FIG. 1 illustrates an apparatus 100. The apparatus 100 may be a mobile apparatus, a cycling computer, a running computer, a multi-sport computer, an activity monitor, or a subscriber terminal of a radio system (such as a mobile phone), for example. The term 'mobile apparatus' 100 refers to a device that a user is capable of moving around. The apparatus 100 may be worn around the wrist, like a watch, or it may be attached to a bicycle, for example. Polar Electro® (www.polarelectro.com) designs and manufactures such apparatuses 100 and their accessories. At the time of filing this patent application, the apparatus 100 may be implemented based on a Polar RS800CX and/or a Polar CS600X, for example. The implementation of the embodiments in such an existing product requires relatively small and well-defined modifications. Naturally, as the products evolve, feasible platforms for the implementation of the embodiments described in this patent application also evolve and emerge.

The apparatus 100 may be a heart rate monitor for measuring the user's heart rate and possibly other parameters that can be measured non-invasively (such as blood pressure). In U.S. Pat. No. 4,625,733, which is incorporated herein by reference, Säynäjäkangas describes a wireless and continuous heart rate monitoring concept where a transmitter to be attached to the user's chest measures the user's ECG-accurate (electrocardiogram) heart rate and transmits the heart rate information telemetrically to a heart rate receiver attached to the user's wrist by using magnetic coils in the transmission.

Other implementations may also be possible. The heart rate monitor may also be implemented such that instead of the solution comprising a chest strap transmitter and a wrist receiver, the heart rate may directly be measured from the wrist on the basis of the pressure, for example. Other ways for measuring the heart rate may also be employed. As sensor technology becomes more integrated, less expensive, and its power consumption characteristics are improved, the sensor measuring heart activity data may also be placed in other arrangements besides the chest strap transmitter. Polar Electro is already marketing clothes that may be provided with separate small sensor units wirelessly communicating with the wrist receiver.

The apparatus 100 comprises a processor 102. The term 'processor' refers to a device that is capable of processing data. The processor 102 may comprise an electronic circuit implementing the required functionality, and/or a microprocessor running a computer program implementing the required functionality. When designing the implementation, a person skilled in the art will consider the requirements set for the size and power consumption of the apparatus, the necessary processing capacity, production costs, and production volumes, for example.

The electronic circuit may comprise logic components, standard integrated circuits, and/or application-specific integrated circuits (ASIC).

The microprocessor implements functions of a central processing unit (CPU) on an integrated circuit. The CPU is a logic machine executing a computer program, which comprises program instructions. The program instructions may be coded as a computer program using a programming language, which may be a high-level programming language, such as C, Java, etc., or a low-level programming language, such as a machine language, or an assembler. The CPU may comprise a set of registers, an arithmetic logic unit (ALU), and a control unit. The control unit is controlled by a sequence of program instructions transferred to the CPU from a program memory. The control unit may contain a number of microinstructions for basic operations. The implementation of the microinstructions may vary, depending on the CPU design. The microprocessor may also have an operating system (a dedicated operating system of an embedded system, or a real-time operating system), which may provide system services to the computer program.

Figure 2:
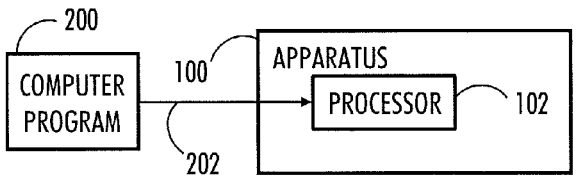
FIG. 2 illustrates a computer program.

FIG. 2 illustrates a computer program 200 run on the processor 102. The computer program 200 may be in source code form, object code form, or in some intermediate form, and it may be stored in some sort of carrier, which may be any entity or device capable of carrying 202 the program to the apparatus 100. The carrier may be implemented as follows, for example: the computer program 200 may be embodied on a record medium, stored in a computer memory, embodied in a read-only memory, carried on an electrical carrier signal, carried on a telecommunications signal, and/or embodied on a software distribution medium.

The processor 102 is configured to obtain 112 exercise data of a user from a measurement sensor. In principle, the measurement sensor measures a physical quantity and converts it into a signal received by the processor 102. A non-exhaustive list of measurement sensors includes: a heart rate sensor, a speed sensor, an acceleration sensor, a cadence sensor, a body temperature sensor, a breathing sensor, a pedalling power sensor, an altimeter, a barometer, a pressure gauge, an ambient temperature sensor, a location sensor, or a wind sensor.

As illustrated in FIG. 1, the sensor may be an internal sensor 110, i.e. a sensor located within the apparatus 100, a wireless external sensor 104, or a wired external sensor 106.

The processor 102 may implement an exercise data input interface 112, which is capable of receiving exercise data from various types of sensors. Naturally, the exercise data input interface 112 may be implemented as a single component or as multiple components.

The internal sensor 110, for example an altimeter (included in Polar RS800CX, for example), may be coupled 130 by a wiring on a printed circuit board with the interface 112, for example.

The wired external sensor 106 may be coupled 132 by a flexible wire with the interface 112, for example. The wired external sensor 106 may be used if wireless communication is not feasible for some reason.

The wireless external sensor 104 may be coupled 126 by electric and/or magnetic radiation with a receiver 108 of the apparatus 100, and the receiver 108 (implemented by an integrated circuit, for example) may be coupled 128 by a wiring on a printed circuit board with the interface 112.

The wireless external sensor 104 may be implemented with an induction-based technology utilizing a magnetic field, or a radio-based technology utilizing electric radiation, for example. It is to be noted that both technologies involve both the magnetic field and the electric radiation, but the separation is based on the fact that either one of these physical phenomena predominates and is only used for the communication in each technology. The induction-based transmission may operate at a kilohertz range frequency (5 kilohertz, 125 kilohertz, or over 200 kilohertz, for example). The radio transmission may utilize a proprietary transceiver (operating at a 2.4 gigahertz frequency, for example), or a Bluetooth transceiver, for example. Emerging ultra low power Bluetooth technology may be used, as its expected use cases include heart rate monitoring. The transmission of the exercise data may utilize any suitable protocols: the principles of time division and/or packet transmission, for example.

Polar products utilize a number of wireless sensors, such as Polar Cycling Speed Sensor W.I.N.D. (for cycling), Polar G3 GPS sensor W.I.N.D. (for GPS information), Polar s3 Stride Sensor W.I.N.D. (for running), Polar Cadence Sensor W.I.N.D. (for cycling), Polar WearLink+ transmitter W.I.N.D. (for heart rate measurement), or Polar Power Output Sensor W.I.N.D. (for cycling).

The exercise data may be divided into two classes: training parameters relating to the user's actions, and environment parameters relating to the environment of the user. The training parameters may comprise electrocardiogram (ECG) information, heart rate, heart rate variability, speed, cadence, body temperature, hydration level, breathing characteristics, pedalling balance, and pedalling power, for example. The environment parameters may comprise altitude, ascent, descent, pressure, ambient temperature, location, and wind characteristics, for example.

The processor 102 is also configured to identify 114 a present exercise phase of an exercise from among a plurality of exercise phases 118 on the basis of the exercise data.

In an embodiment, the processor 102 is configured to exclude the heart rate from the exercise data, on the basis of which the present exercise phase is identified, i.e. the exercise phase identification 114 is not based on the heart rate but on the other types of exercise data. It is to be noted that such other type of exercise data may include any other kind of electrocardiogram (ECG) information except heart rate.

The exercise phase may be an interval training period, a recovery period, an uphill phase, a downhill phase, a warm-up phase, a head-wind phase, a side-wind phase, a hydration break, and/or crossroads, for example. The exercise phases may be predetermined, i.e. the processor may store a number of rules with which a present exercise situation is detected, i.e. a stored exercise phase which best matches the rules is selected as the present exercise phase. The identification of the present exercise phase may be based on identifying a change in at least one type of exercise data.

In an embodiment, the processor 102 is configured to identify 114 a present exercise phase of an exercise from among a plurality of exercise phases 118 on the basis of at least parameters selected among the training parameters and/or the environment parameters.

If the speed of the bicycle increases rapidly within a short period of time, but the altitude of the bicycle remains relative stationary (=the bicycle is not going downhill), it may be detected that a speed-interval has started, for example. A rule with which an exercise phase is identified may be user customizable. The user may be able to set a limit for starting a heart rate interval, for example.

In an embodiment, the processor 102 is also configured to recognize a change in the exercise data, to mark the recognized change as a change point in order to distinguish between successive exercise phases, and to store the change point. This embodiment may aid in analyzing the stored exercise data, either during the exercise, or after the exercise, even in such a case where the exercise data is downloaded from the apparatus to a computer. The computer may be a personal computer (such as a desktop computer, a laptop computer, or a palmtop computer). The computer may also be a server computer. The computer may store and process exercise data of countless persons. The computer may be team specific, i.e. it may be used to process the exercise data of a certain team.

Alternatively, the computer may provide exercise data storage and analysis services to a wide audience, as a world-wide web (WWW) server over the Internet, for example.

In another embodiment, the processor 102 is also configured to start a predetermined measurement corresponding to the present exercise phase. This embodiment may remove the need of the user to press a button in order to start the measurement, which may improve the safety of the user, while s/he is running or bicycling, for example.

The processor 102 is also configured to select 116 a relevant display mode from among a plurality of display modes 120 on the basis of the present exercise phase and a mapping 122 between the display modes 120 and the exercise phases 118, wherein the relevant display mode defines a set of display elements associated with the present exercise phase to be displayed to the user. The display mode may be displayed to the user by a display 124 that may be implemented with any suitable display technology. The display mode may comprise at least two display elements selected from a group comprising: heart rate, heart rate variability, speed, cadence, body temperature, hydration level, breathing characteristics, pedalling balance, pedalling power, altitude, ascent, descent, pressure, ambient temperature, location, and wind characteristics. Naturally, also any other data obtained directly from the measurement sensors, or processed on the basis of data obtained from one or more measurement sensors, may form a display element.

Figure 3:
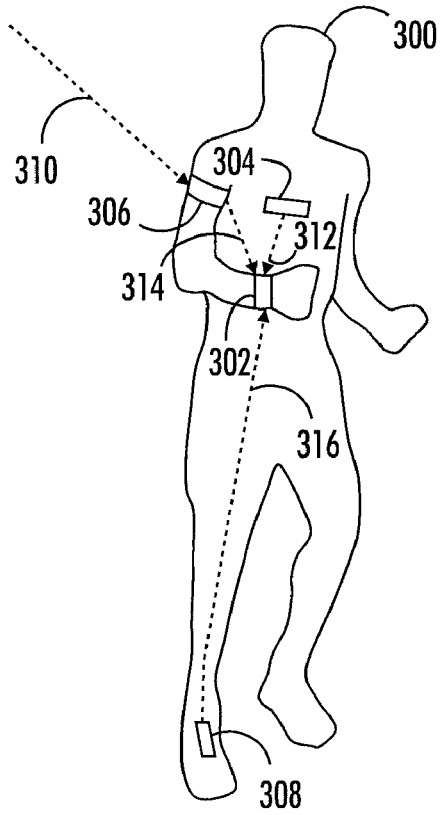
FIG. 3 illustrates a running computer.

FIG. 3 illustrates an embodiment where the apparatus 100 is implemented as a running computer, a Polar RS800CX, for example. A runner 300 is provided with the following equipment: a wrist receiver 302, a chest strap transmitter 304, an upper-arm-mounted positioning receiver 306, and a shoe-mounted stride sensor 308. The accessories 304, 306, 308 communicate 312, 314, 316 wirelessly with the wrist receiver 302.

The positioning receiver 306 receives 310 external location information. The positioning receiver 306 may be a receiver of a global navigation satellite system. Such a system may be the Global Positioning System (GPS), the Global Navigation Satellite System (GLONASS), the Galileo Positioning System (Galileo), the Beidou Navigation System, or the Indian Regional Navigational Satellite System (IRNSS), for example. The positioning receiver 306 determines its location (longitude, latitude, and altitude) using time signals 310 transmitted along a line of sight by radio from satellites orbiting the earth. Besides global navigation satellites, the positioning receiver 306 may also determine its location utilizing other known positioning techniques. It is well known that by receiving radio signals from several different base stations, the mobile phone may determine its location.

Figure 4:
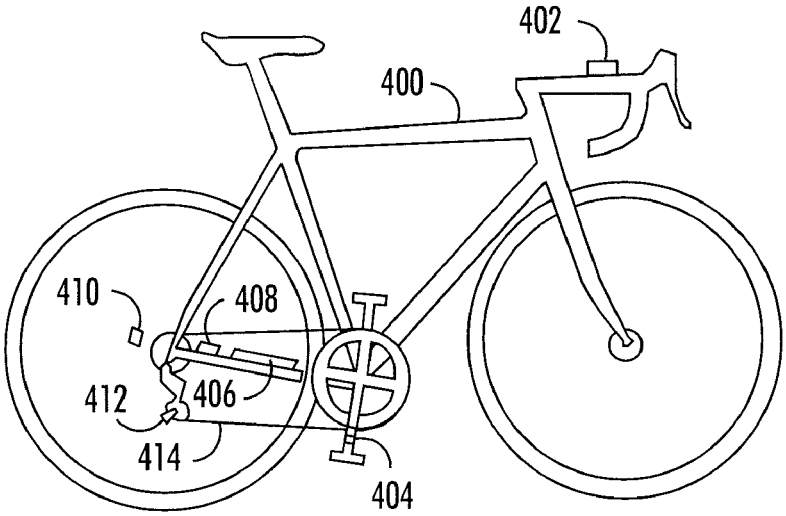
FIG. 4 illustrates a cycling computer.

FIG. 4 illustrates an embodiment where the apparatus 100 is implemented as a cycling computer, a Polar CS600 with a power sensor, for example. A bicycle 400 is provided with the following equipment: a handlebar-mounted user interface unit 402, a cadence magnet 404 placed on the right crank arm, a power sensor main unit 406 mounted on the right chain stay, a wheel speed sensor 408 placed on the left chain stay, a wheel speed magnet 410 placed on a spoke (for the sake of clarity, spokes are not illustrated in FIG. 4), and a chain speed sensor 412 placed around the lower pulley wheel of the rear derailleur. Cadence information is obtained from the power sensor main unit 406 as the cadence magnet 404 passes it. Speed information is obtained from the wheel speed sensor 408 as the wheel speed magnet 410 passes it. Pedalling power and pedalling balance information is obtained from the power sensor main unit 406 as the chain speed sensor 412 measures the speed of a chain 414, and the power sensor main unit 406 measures the vibration of the chain 414 while pedalling.

Next, with reference to FIGS. 6, 7, 8, 9, and 10, various display mode sequences are explained.

Figure 6:
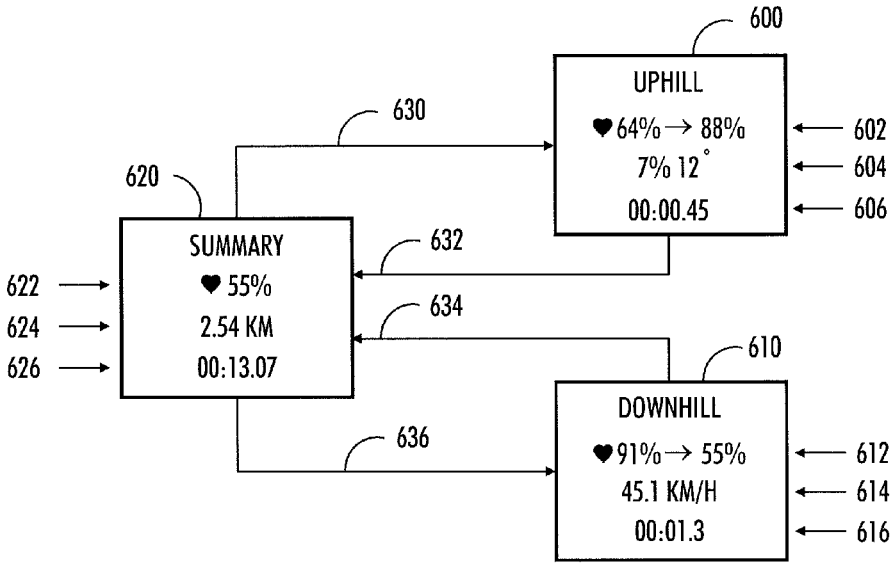
FIGS. 6, 7, 8, 9, and 10 illustrate various display mode sequences.

In FIG. 6, the following information is available from various measurement sensors: altitude, speed, distance, and heart rate. With this information, automatic display mode selection is possible for the uphill display mode and the downhill display mode.

A summary display mode 620 is displayed during the exercise with the following display elements: a present heart rate 622 as a percentage of the maximum heart rate, a travelled distance 624 in kilometres, and an elapsed exercise time 626 in hours, minutes and seconds.

If an altitude increase exceeds a predetermined threshold (a predetermined amount of metres within a predetermined amount of seconds, for example), the sequence enters 630 an uphill display mode 600 with the following display elements: increase in heart rate, starting from the bottom of the hill 602 (the heart rate was 64% at the bottom of the hill, presently being 88%), steepness of the hill 604 (expressed both as an elevation percentage and as an elevation degree), and an elapsed time going uphill 606.

If an altitude decrease exceeds a predetermined threshold, the sequence enters 636 a downhill display mode 610 with the following display elements: decrease in heart rate, starting from the top of the hill 612 (the heart rate was 91% at the top of the hill, presently being 55%), speed 614, and an elapsed time going downhill 616.

If the altitude increase/decrease ceases to exceed the predetermined threshold (altitude remains constant for a predetermined time, for example), the sequence returns 632, 634 to the summary display mode 620.

Figure 7:
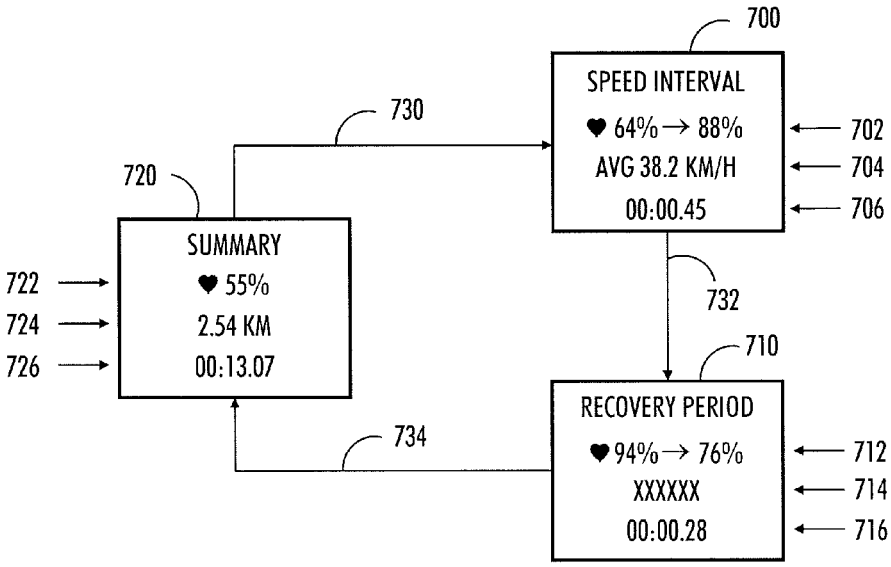

In FIG. 7, the following information is available from various measurement sensors: altitude, speed, distance, and heart rate. With this information, changes in a relative speed may be detected.

During the exercise, a summary display mode 720 is displayed with the following display elements: a present heart rate 722, a travelled distance 724, and an elapsed exercise time 726.

If a speed increase exceeds a predetermined threshold, but the altitude change remains within predetermined limits, the sequence enters 730 a speed interval display mode 700 with the following display elements: increase in heart rate, starting from the start of the speed interval 702, average speed during the speed interval 704, and an elapsed time since the start of the speed interval 706.

If a speed interval has lasted for at least a predetermined period, and a speed decrease exceeds a predetermined threshold, the sequence enters 732 a recovery period display mode 710 with the following display elements: decrease in heart rate, starting from the start of the recovery period 712, a reaction diagram 714 illustrating the previous speed interval, and an elapsed recovery time 716.

When the heart rate has dropped to the recovery level, the recovery period display mode 710 is swapped 734 for the summary display mode 720.

Figure 8:
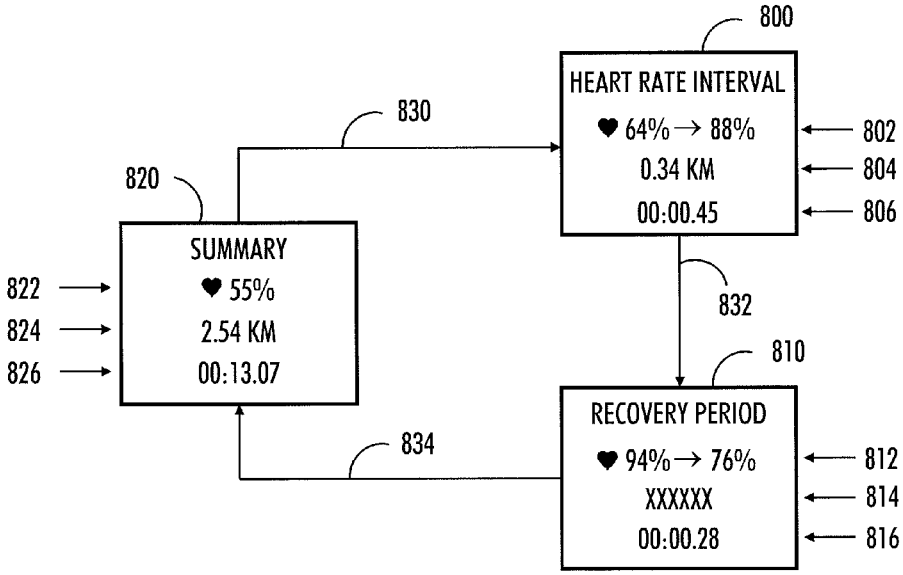

In FIG. 8, the following information is available from various measurement sensors: speed, distance, and heart rate. Changes in exercise intensity may be detected, and a suitable display mode may be selected.

During the exercise, a summary display mode 820 is displayed with the following display elements: a present heart rate 822, a travelled distance 824, and an elapsed exercise time 826.

If the heart rate increase exceeds a predetermined threshold, the sequence enters 830 a heart rate interval display mode 800 with the following display elements: increase in heart rate, starting from the start of the heart rate interval 802, travelled distance during the heart rate interval 804, and an elapsed time since the start of the heart rate interval 806.

If the heart rate drops sufficiently, the sequence enters 832 a recovery period display mode 810 with the following display elements: decrease in heart rate, starting from the start of the recovery period 812, a reaction diagram 814 illustrating the previous heart rate interval, and an elapsed recovery time 816.

When the heart rate has dropped to the recovery level, the recovery period display mode 810 is swapped 834 for the summary display mode 820.

Figure 9:
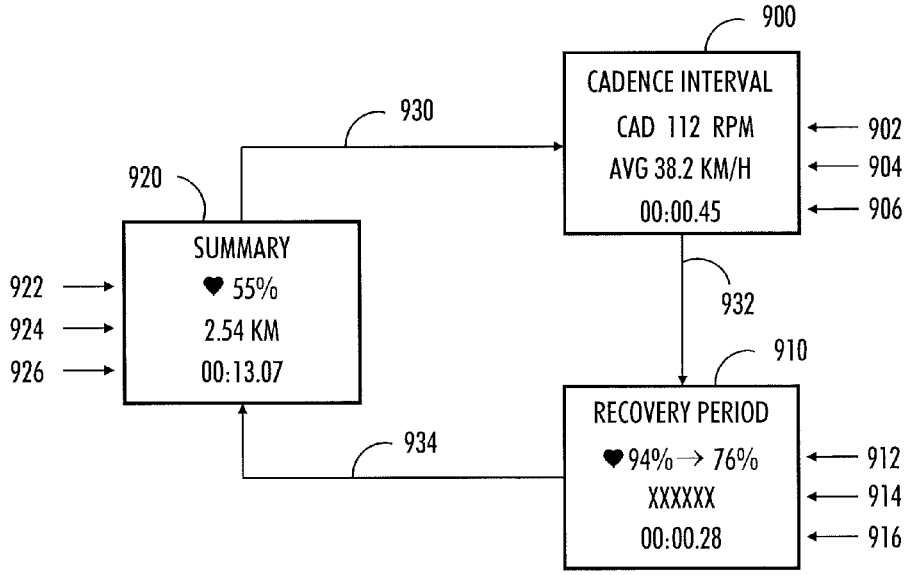

In FIG. 9, the following information is available from various measurement sensors: cadence, altitude, speed, distance, and heart rate. With this information, a so-called over-pedalling interval may be detected, and the suitable display mode may be selected. Such over-pedalling intervals may be utilized for training the nervous system necessary for effective pedalling.

During the exercise, a summary display mode 920 is displayed with the following display elements: a present heart rate 922, a travelled distance 924, and an elapsed exercise time 926.

If a cadence increase exceeds a predetermined threshold, but the altitude change remains within predetermined limits, the sequence enters 930 a cadence interval display mode 900 with the following display elements: cadence 902 as rotations per minute, average speed during the cadence interval 904, and an elapsed time since the start of the cadence interval 906.

If a cadence decrease exceeds a predetermined threshold, but the altitude change remains within predetermined limits, the sequence enters 932 a recovery period display mode 910 with the following display elements: decrease in heart rate, starting from the start of the recovery period 912, a reaction diagram 914 illustrating the previous cadence interval, and an elapsed recovery time 916.

When the heart rate has dropped to the recovery level, the recovery period display mode 910 is swapped 934 for the summary display mode 920.

Figure 10:
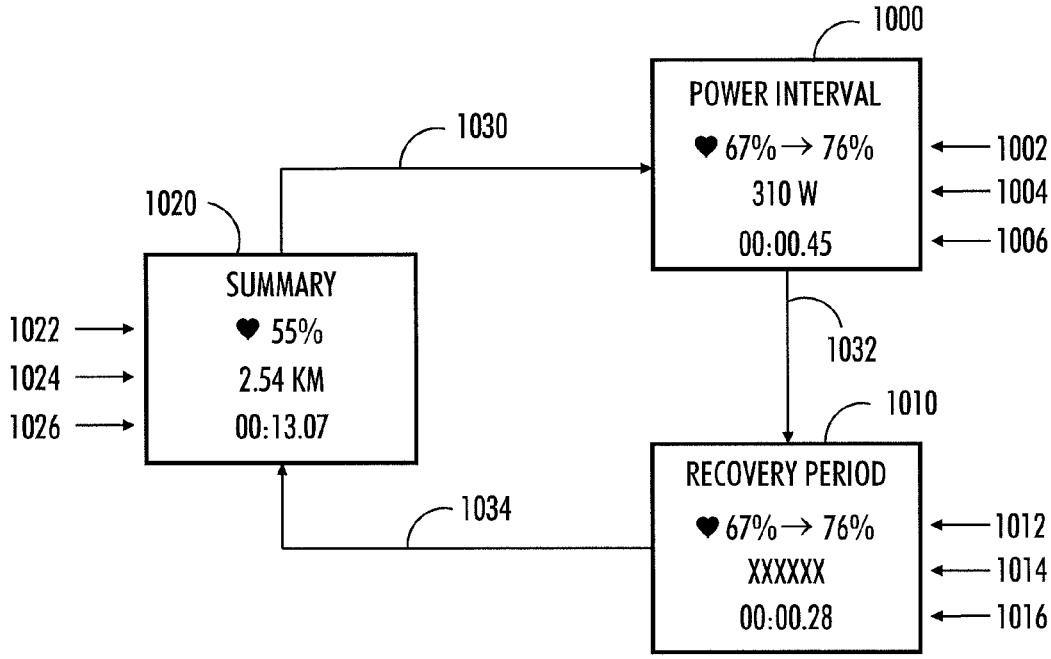

In FIG. 10, the following information is available from various measurement sensors: pedalling power, altitude, speed, distance, and heart rate. This information may be used to recognize so-called power-production intervals, and to select the suitable display modes.

During the exercise, a summary display mode 1020 is displayed with the following display elements: a present heart rate 1022, a travelled distance 1024, and an elapsed exercise time 1026.

If the pedalling power increase exceeds a predetermined threshold, but the altitude change remains within predetermined limits, a power interval display mode 1000 is entered 1030 with the following display elements: increase in heart rate, starting from the start of the power interval 1002, average pedalling power in watts 1004, and an elapsed time since the start of the power interval 1006.

If a pedalling power decrease exceeds a predetermined threshold, but the altitude change remains within predetermined limits, the sequence enters 1032 a recovery period display mode 1010 with the following display elements: decrease in heart rate, starting from the start of the recovery period 1012, a reaction diagram 1014 illustrating the previous power interval, and an elapsed recovery time 1016.

When the heart rate has dropped to the recovery level, the recovery period display mode 1010 is swapped 1034 for the summary display mode 1020.

Even though FIGS. 6 to 10 only show relatively simple embodiments, also more elaborate scenarios are feasible. For example: if not enough room is provided on the display for all display elements that are relevant to the present exercise phase, these display elements may be divided between at least two relevant display modes that are alternated during the exercise phase.

Figure 5:
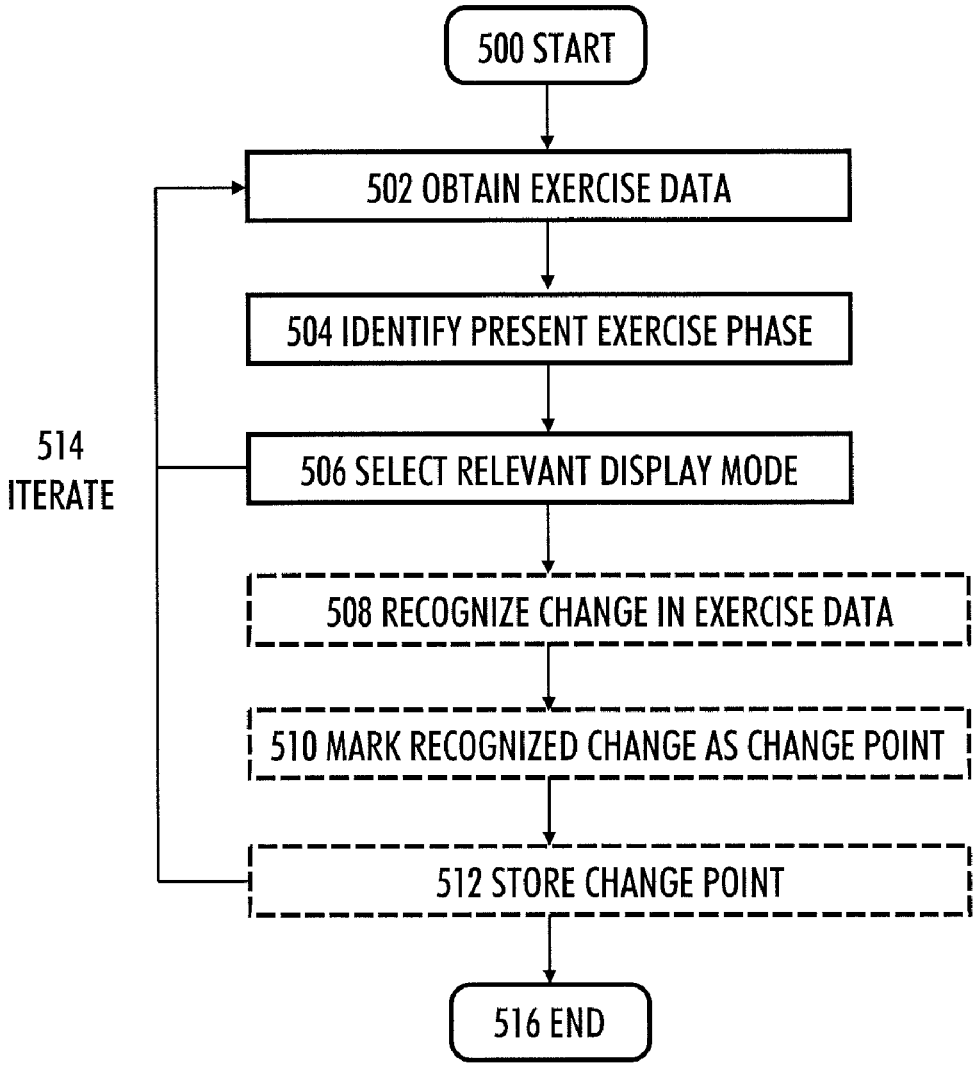
FIG. 5 illustrates a method.

Next, a method will be described with reference to FIG. 5. The operations described in FIG. 5 are in no absolute chronological order. Other functions, not described in this application, may also be executed between the operations or within the operations. Some of the operations or parts of the operations may also be left out or replaced by a corresponding operation or part of the operation. The method starts in 500. In 502, exercise data of a user is obtained. In 504, a present exercise phase of an exercise is identified from among a plurality of exercise phases on the basis of the exercise data. In 506, a relevant display mode is selected from among a plurality of display modes on the basis of the present exercise phase and a mapping between display modes and the exercise phases, wherein the relevant display mode defines a set of display elements associated with the present exercise phase to be displayed to the user. The method ends in 516, but before that operations 502, 504, and 506 are iterated as long as necessary.

The above-described embodiments of the apparatuses may also be used to enhance the method. In 508, a change in the exercise data may be recognized. In 510, the recognized change may be marked as a change point in order to distinguish between successive exercise phases. In 512, the change point may be stored.

It will be obvious to a person skilled in the art that as technology advances, the inventive concept can be implemented in various ways. The invention and its embodiments are not limited to the examples described above but may vary within the scope of the claims.

What is claimed is:

1. An apparatus comprising:

a processing device configured to obtain exercise data of a user from a plurality of measurement sensors associated with bicycling, the exercise data comprising training parameters relating to the user's actions during bicycling, at least one of the measurement sensors being a speed sensor, the exercise data comprising speed data, the processing device identifying a present exercise phase of an exercise from among a plurality of exercise phases on the basis of the speed data, the processing device selecting a relevant display mode from among a plurality of display modes on the basis of the present exercise phase and a mapping between the display modes and the exercise phases, the processing device automatically switching between display modes relevant to the present exercise phase based on the speed data, wherein the relevant display mode defines a set of display elements associated with the present exercise phase to be displayed to the user, wherein each display element comprises exercise data; and a display configured to display the relevant display mode to the user during bicycling, the plurality of display modes comprising a summary display mode comprising a present heart rate, a travelled distance, and an elapsed exercise time as display elements, and at least one of the following:

an uphill display mode comprising increase in heart rate, starting from the bottom of the hill, steepness of the hill, and an elapsed time going uphill as display elements;

a downhill display mode comprising decrease in heart rate, starting from the top of the hill, speed, and an elapsed time going downhill as display elements;

a speed interval display mode comprising increase in heart rate, starting from the start of the speed interval, average speed during the speed interval, and an elapsed time since the start of the speed interval as display elements;

a recovery period display mode comprising decrease in heart rate, starting from the start of the recovery period, a reaction diagram illustrating a previous speed interval, and an elapsed recovery time as display elements;

a heart rate interval display mode comprising increase in heart rate, starting from the start of the heart rate interval, travelled distance during the heart rate interval, and an elapsed time since the start of the heart rate interval as display elements;

a recovery period display mode comprising decrease in heart rate, starting from the start of the recovery period, a reaction diagram illustrating a previous heart rate interval, and an elapsed recovery time as display elements;

a cadence interval display mode comprising cadence as rotations per minute, average speed during the cadence interval, and an elapsed time since the start of the cadence interval as display elements;

a recovery period display mode comprising decrease in heart rate, starting from the start of the recovery period, a reaction diagram illustrating the previous cadence interval, and an elapsed recovery time as display elements;

a power interval display mode comprising increase in heart rate, starting from the start of the power interval, average pedalling power in watts, and an elapsed time since the start of the power interval as display elements;

a recovery period display mode comprising decrease in heart rate, starting from the start of the recovery period, a reaction diagram illustrating the previous power interval, and an elapsed recovery time as display elements; and another display mode comprising at least two display elements selected from a group comprising: heart rate, heart rate variability, speed, cadence, body temperature, hydration level, breathing characteristics, pedalling balance, pedalling power, altitude, ascent, descent, pressure, ambient temperature, location, and wind characteristics.

2. The apparatus of claim 1, further comprising an altimeter configured to measure altitude data, the processing unit being configured to identify a speed interval exercise phase on the basis of the speed data and the altitude data, the relevant display mode being a speed-interval display mode.

3. The apparatus of claim 2, wherein at least one of the measurement sensors is a heart rate sensor, the exercise data comprising the user's heart rate, at least one display element comprising an increase in the user's heart rate starting from a start of the speed interval exercise phase.

4. The apparatus of claim 1, further comprising an altimeter configured to measure altitude data, the processing unit being configured to identify a recovery period exercise phase on the basis of the speed data and the altitude data, the relevant display mode being a recovery display mode.

5. The apparatus of claim 4, wherein at least one of the measurement sensors is a heart rate sensor, the exercise data comprising the user's heart rate, at least one display element comprising a decrease in the user's heart rate starting from a start of the recovery period exercise phase.

6. An apparatus comprising:

a processing device configured to obtain exercise data of a user from a plurality of measurement sensors associated with bicycling, the exercise data comprising training parameters relating to the user's actions during bicycling, at least one of the measurement sensors being an altimeter, the exercise data comprising altitude data, the processing device identifying a present exercise phase of an exercise from among a plurality of exercise phases on the basis of the altitude data, the processing device selecting a relevant display mode from among a plurality of display modes on the basis of the present exercise phase and a mapping between the display modes and the exercise phases, the processing device automatically switching between display modes relevant to the present exercise phase based on the altitude data, wherein the relevant display mode defines a set of display elements associated with the present exercise phase to be displayed to the user, wherein each display elements comprises exercise data; and a display configured to display the relevant display mode to the user during bicycling, the plurality of display modes comprising a summary display mode comprising a present heart rate, a travelled distance, and an elapsed exercise time as display elements, and at least one of the following:

an uphill display mode comprising increase in heart rate, starting from the bottom of the hill, steepness of the hill, and an elapsed time going uphill as display elements;

a downhill display mode comprising decrease in heart rate, starting from the top of the hill, speed, and an elapsed time going downhill as display elements;

a speed interval display mode comprising increase in heart rate, starting from the start of the speed interval, average speed during the speed interval, and an elapsed time since the start of the speed interval as display elements;

a recovery period display mode comprising decrease in heart rate, starting from the start of the recovery period, a reaction diagram illustrating a previous speed interval, and an elapsed recovery time as display elements;

a heart rate interval display mode comprising increase in heart rate, starting from the start of the heart rate interval, travelled distance during the heart rate interval, and an elapsed time since the start of the heart rate interval as display elements;

a recovery period display mode comprising decrease in heart rate, starting from the start of the recovery period, a reaction diagram illustrating a previous heart rate interval, and an elapsed recovery time as display elements;

a cadence interval display mode comprising cadence as rotations per minute, average speed during the cadence interval, and an elapsed time since the start of the cadence interval as display elements;

a recovery period display mode comprising decrease in heart rate, starting from the start of the recovery period, a reaction diagram illustrating the previous cadence interval, and an elapsed recovery time as display elements;

a power interval display mode comprising increase in heart rate, starting from the start of the power interval, average pedalling power in watts, and an elapsed time since the start of the power interval as display elements;

a recovery period display mode comprising decrease in heart rate, starting from the start of the recovery period, a reaction diagram illustrating the previous power interval, and an elapsed recovery time as display elements; and another display mode comprising at least two display elements selected from a group comprising: heart rate, heart rate variability, speed, cadence, body temperature, hydration level, breathing characteristics, pedalling balance, pedalling power, altitude, ascent, descent, pressure, ambient temperature, location, and wind characteristics.

7. The apparatus of claim 6, wherein the processing unit is configured to identify an uphill exercise phase on the basis of the altitude data, the relevant display mode being an uphill display mode.

8. The apparatus of claim 7, wherein at least one of the measurement sensors is a heart rate sensor, the exercise data comprising the user's heart rate, at least one of the display elements comprising an increase in the user's heart rate starting from a start of the uphill exercise phase.

9. The apparatus of claim 6, wherein the processing unit is configured identify a downhill exercise phase, the relevant display mode being a downhill display mode.

10. The apparatus of claim 9, wherein at least one of the measurement sensors is a heart rate sensor and the exercise data comprises the user's heart rate, at least one of the display elements comprising a decrease in the user's heart rate starting from a start of the downhill exercise phase.

11. An apparatus comprising:

a processing device configured to obtain exercise data of a user from a plurality of measurement sensors associated with bicycling, the exercise data comprising training parameters relating to the user's actions during bicycling, at least one of the measurement sensors being a cadence sensor, the exercise data comprising cadence data, the processing device identifying a present exercise phase of an exercise from among a plurality of exercise phases on the basis of the cadence data, the processing device selecting a relevant display mode from among a plurality of display modes on the basis of the present exercise phase and a mapping between the display modes and the exercise phases, the processing device automatically switching between display modes relevant to the present exercise phase based on the cadence data, wherein the relevant display mode defines a set of display elements associated with the present exercise phase to be displayed to the user, wherein each display element comprises exercise data, the cadence data only representing a rate of pedal motion; and a display configured to display the relevant display mode to the user during bicycling, wherein the plurality of display modes comprises a summary display mode comprising a present heart rate, a travelled distance, and an elapsed exercise time as display elements, and at least one of the following:

a cadence interval display mode comprising cadence as rotations per minute, average speed during the cadence interval, and an elapsed time since the start of the cadence interval as display elements;

a recovery period display mode comprising decrease in heart rate, starting from the start of the recovery period, a reaction diagram illustrating the previous cadence interval, and an elapsed recovery time as display elements;

a power interval display mode comprising increase in heart rate, starting from the start of the power interval, average pedalling power in watts, and an elapsed time since the start of the power interval as display elements;

a recovery period display mode comprising decrease in heart rate, starting from the start of the recovery period, a reaction diagram illustrating the previous power interval, and an elapsed recovery time as display elements; and another display mode comprising at least two display elements selected from a group comprising: heart rate, heart rate variability, speed, cadence, body temperature, hydration level, breathing characteristics, pedalling balance, pedalling power, altitude, ascent, descent, pressure, ambient temperature, location, and wind characteristics.

12. The apparatus of claim 11 wherein the processing unit is configured to identify an over-pedaling interval exercise phase on the basis of the cadence data, the relevant display mode being an over-pedaling display mode.

13. The apparatus of claim 12, wherein the plurality of measurement sensors further comprises a speed sensor and the exercise data comprises speed, at least one of the display elements comprising an average speed during the over-pedaling interval exercise phase, the plurality of display modes comprising at least one of:

an uphill display mode comprising increase in heart rate, starting from the bottom of the hill, steepness of the hill, and an elapsed time going uphill as display elements;

a downhill display mode comprising decrease in heart rate, starting from the top of the hill and present heart rate, speed, and an elapsed time going downhill as display elements;

a speed interval display mode comprising increase in heart rate, starting from the start of the speed interval, average speed during the speed interval, and an elapsed time since the start of the speed interval as display elements;

a recovery period display mode comprising decrease in heart rate, starting from the start of the recovery period, a reaction diagram illustrating a previous speed interval, and an elapsed recovery time as display elements;

a heart rate interval display mode comprising increase in heart rate, starting from the start of the heart rate interval, travelled distance during the heart rate interval, and an elapsed time since the start of the heart rate interval as display elements;

a recovery period display mode comprising decrease in heart rate, starting from the start of the recovery period, a reaction diagram illustrating a previous heart rate interval, and an elapsed recovery time as display elements.

14. The apparatus of claim 1, wherein the processing device is configured to recognize a change in the exercise data, mark the recognized change as a change point, and store the change point.

15. The apparatus of claim 6, wherein the processing device is configured to recognize a change in the exercise data, mark the recognized change as a change point, and store the change point.

16. The apparatus of claim 11, wherein the processing device is configured to recognize a change in the exercise data, mark the recognized change as a change point, and store the change point.

17. The apparatus of claim 1, wherein the exercise phase comprises at least one of the following: speed interval training period, a heart rate interval training period, an over-pedalling interval training period, a power-production interval training period, a recovery period, an uphill phase, a downhill phase, a warm-up phase, a head-wind phase, a side-wind phase, a hydration break, and crossroads.

18. The apparatus of claim 6, wherein the exercise phase comprises at least one of the following: speed interval training period, a heart rate interval training period, an over-pedalling interval training period, a power-production interval training period, a recovery period, an uphill phase, a downhill phase, a warm-up phase, a head-wind phase, a side-wind phase, a hydration break, and crossroads.

19. The apparatus of claim 11, wherein the exercise phase comprises at least one of the following: speed interval training period, a heart rate interval training period, an over-pedalling interval training period, a power-production interval training period, a recovery period, an uphill phase, a downhill phase, a warm-up phase, a head-wind phase, a side-wind phase, a hydration break, and crossroads.

* * * * *

UNITED STATES PATENT AND TRADEMARK OFFICE

CERTIFICATE OF CORRECTION

PATENT NO. : 8,206,268 B2
APPLICATION NO. : 13/004270
DATED : June 26, 2012
INVENTOR(S) : Haataja It is certified that error appears in the above-identified patent and that said Letters Patent is hereby corrected as shown below:

In the Claims

Col. 11, Claim 9, line 21, delete "is configured identify", and should read --is configured to identify--

Signed and Sealed this
Twenty-fifth Day of February, 2014

Michelle K. Lee

Michelle K. Lee
*Deputy Director of the United States Patent and Trademark Office*